United States Patent [19]

Walton

[11] 4,142,645

[45] Mar. 6, 1979

[54] VACUUM SEALING CLOSURE LID FOR HOME CANNING OPERATIONS

[76] Inventor: Donald G. Walton, 4907 N. Damen Ave., Chicago, Ill. 60625

[21] Appl. No.: 892,551

[22] Filed: Apr. 12, 1978

[51] Int. Cl.[2] ..... B65D 51/16

[52] U.S. Cl. ..... 215/260; 215/262; 215/312; 137/526; 137/533.11; 251/342

[58] Field of Search ..... 215/260, 262, 266, 271, 215/312; 220/203, 209; 141/65; 99/472; 251/342; 137/526, 533.11

[56] References Cited

U.S. PATENT DOCUMENTS

| | | | |
|---|---|---|---|
| 869,154 | 10/1907 | Ayling | 215/312 |
| 2,449,014 | 9/1948 | Shaffer | 215/260 |
| 2,518,165 | 8/1950 | Millard | 251/342 X |

FOREIGN PATENT DOCUMENTS

| | | | |
|---|---|---|---|
| 890894 | 9/1953 | Fed. Rep. of Germany | 215/262 |
| 172807 | 12/1921 | United Kingdom | 215/262 |

*Primary Examiner*—Donald F. Norton
*Attorney, Agent, or Firm*—Edward R. Lowndes

[57] ABSTRACT

A closure for food containers embodying an open-ended resilient tubular elastomeric nipple adapted for connection to a source of vacuum so that air within the container may be evacuated prior to storage of the container and its contents. The nipple is provided with an inner frusto-conical wall of small slant angle which constitutes a valve seat. A spherical ball loosely disposed within the nipple is forcefully drawn against the seat incident to differential air pressure on opposite sides of the ball. Unseating of the ball to equalize the air pressure inside and outside the container is accomplished by pinching the nipple immediately below the ball. An obstruction near the upper rim of the nipple prevents escape of the ball during evacuation of the container or during handling of the closure.

5 Claims, 6 Drawing Figures

VACUUM SEALING CLOSURE LID FOR HOME CANNING OPERATIONS

The present invention relates to home canning apparatus and has particular reference to a jar-sealing lid which has associated therewith a novel check valve mechanism adapted for connection to a source of sub-atmospheric pressure (which will be referred to simply as vacuum pressure) and which is more sensitive to pressure differentials than has heretofore been possible in connection with check valve mechanisms which are employed for the same purpose.

There are in existence at the present time numerous devices for evacuating jars and other vessels containing perishable foodstuffs and for thereafter maintaining vacuum pressure within the vessel. Insofar as home canning apparatus is concerned, such devices have been employed in household use for the repeated exhaustion of air from jars after an initial opening of the jars and a consumption of the partial contents. Such devices also have been employed for the repeated evacuation of air from factory sealed jars and other containers which are purchased on the market for household use. It will be understood of course that the withdrawal of air from a jar after each use greatly enhances the life of the remaining contents whether the contents be factory or home sealed.

Previously known jar sealing devices or those in current use are possessed of several limitations and, principal among these is the unreliability of the check valve mechanisms associated therewith. Many such valves are predicated upon flap valve structures which employ unyielding cooperating valve surfaces which, in time, are apt to become worn and thus lose their effectiveness. Any leak, however minuscule, will, in time, whether it be a matter of hours or days, bleed a vacuumized jar to atmospheric pressure. Upon such bleeding, the sterility of the jar contents is destroyed and deterioration sets in. Stated otherwise, if a seal is to maintain sterility of the jar contents indefinitely such seal must be perfect. Even where elastomeric or plastic washers are employed as seal seats, small particles of food or other foreign material occasionally will cause unseating of a valve body and render the operation of the valve something less than perfect.

The present invention is designed to overcome the above-noted limitation that is attendant upon the construction and use of conventional jar sealing valves which are associated with air evacuation nipples and, toward this end, the invention contemplates the provision of a novel valved nipple assembly wherein the nipple body is tubular and is formed of a resilient elastomeric material such as rubber and wherein the valve element or body is in the form of a spherical ball-like member of significant mass and which cooperates with an internal frusto-conical seat of small slant angle and relatively long slant height. The nipple is designed for operative connection to a source of sub-atmospheric pressure and, when so connected, the valve body will be lifted from its seat to allow air to be drawn from the jar or other container. When the vacuum source is disconnected, the ball-like valve body will again become seated. However, unlike valves which employ unyielding valve seats, or valves where valve seating always takes place with the same valve and seat relationship, the valve body of the present invention seldom, if ever, seats on the slightly tapered yielding frusto-conical seat surface with the same exact relationship. For example, the depth at which the ball is drawn into the tapered valve seat is a function of the degree of sub-atmospheric pressure that is maintained within the jar. Additionally, when the ball is in its floating condition due to raising thereof from the seat when the vacuum is applied, it rotates indiscriminately in all directions so that when it ultimately is drawn against the seat it seldom assumes the same rotational or circumferential position thereon. Moreover, any small food particles that may be present on either the ball or the valve seat become practically embedded in the resilient material of the seat and thereby are rendered innocuous.

Another limitation that is present in connection with present day jar-evacuating nipples resides in the fact that after evacuation is completed, it is difficult to reopen the jar due to the fact that no means is provided for relieving the vacuum pressure within the jar and unscrewing of the lid is appreciably resisted. If gasketed jar covers are used, prying of the lid is apt to deform the latter so that it is not reuseable or, alternatively, the elastomeric gasket is frequently damaged.

The present invention also overcomes this second limitation in that it affords a simple and easily performed valve unseating expedient which consists simply in pinching the nipple at a region slightly below the level of the valve body or ball. Such a pinching operation deforms the nipple so that the internal frusto-conical valve seat becomes elongated in one direction and thus assumes a generally elliptical or oval configuration, thereby allowing air to escape from the jar around the opposite sides of the spherical valve body.

The provision of a nipple assembly such as has briefly been outlined above, and possessing the stated advantages, constitutes the principal object of the present invention. Other objects and advantages of the invention, not at this time enumerated, will become readily apparent as the following description ensues.

In the accompanying single sheet of drawings forming a part of this specification, one illustrative embodiment of the invention has been shown.

Figure 1:
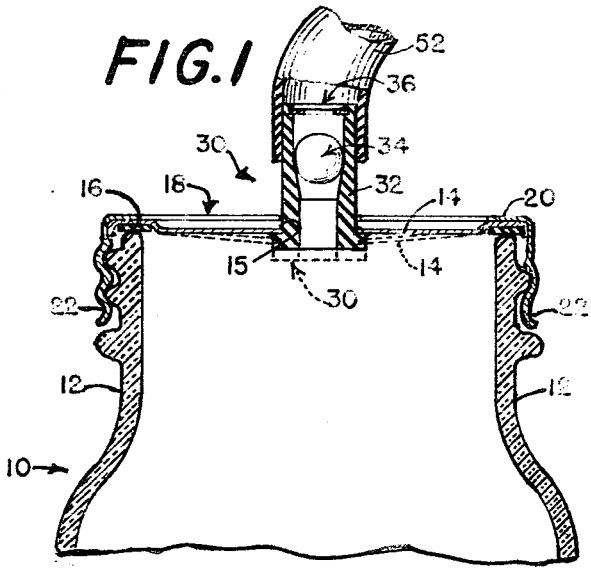
FIG. 1 is a sectional view taken substantially centrally and vertically through a food jar and showing the improved nipple-equipped evacuating jar closure operatively applied thereto.
Figure 4:
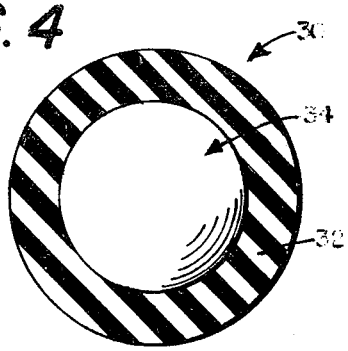
FIG. 4 is a sectional view taken on the line 4—4 of FIG. 2.

Referring now to the drawings in detail and in particular to FIG. 1, a conventional food jar is fragmentarily shown in this view and it is designated in its entirety by the reference numeral 10. Such jar is shown herein as being in the form of a conventional Mason type "fruit jar" having the usual reduced threaded neck portion 12 but it will be understood that the present invention may, if desired, be applied to other forms of containers of the open-mouth type whether the same be constructed of glass or metal. Jars of the type illustrated herein are available on the market and they are normally designed for cooperation with metal screw-down closure caps commonly referred to as lids.

The closure member of the present invention involves in its general organization a flat annular disk-like lid 14 having a central vent opening 15 therein and which is equipped with a peripheral elastomeric or other gasket 16 that seats on the circular rim of the neck portion 12 when such lid is operatively in position on the jar 10. A screw-down retainer or ring 18 of cup-shaped configuration is provided with an annular clamping flange 20 adapted to bear against the peripheral regions of the lid 14, and a depending threaded skirt portion 22 designed for threaded reception over the neck portion 12 of the jar 10. to maintain the lid in position on the jar against dislodgment.

Figure 2:
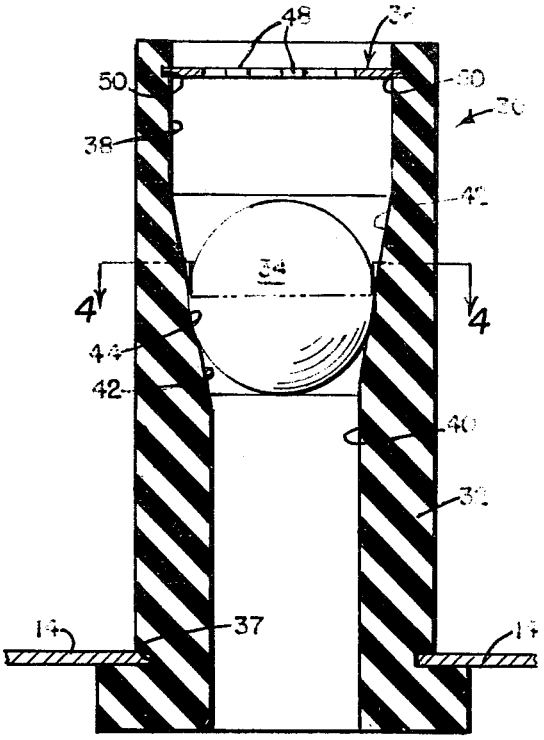
FIG. 2 is an enlarged detail view of the valved nipple assembly, showing the same in the condition which it assumes when the jar is evacuated.
Figure 3:
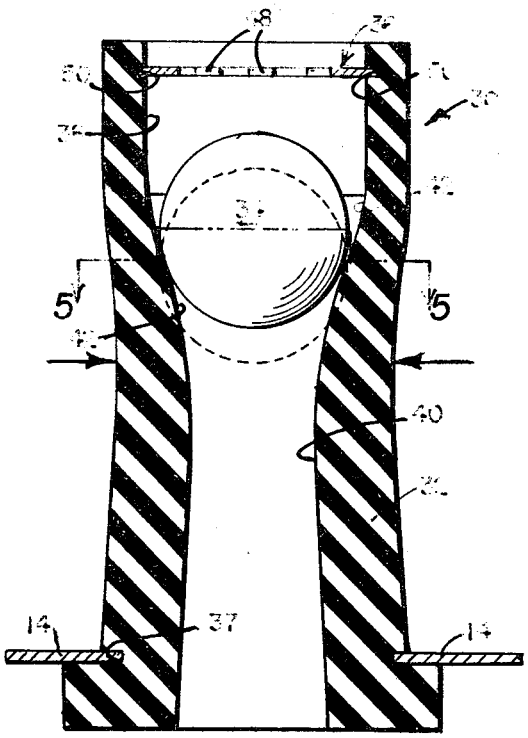
FIg. 3 is a sectional view similar to FIG. 2, and illustrating schematically the manner in which the interior of the jar is manually relieved of its sub-atmospheric pressure.

Referring now, additionally, to FIG. 2, the lid 18 is provided with a centrally disposed nipple assembly 30 which is comprised of three principal parts, namely the nipple proper 32, a valve body 34 and a retaining washer 36.

The nipple proper 32 is in the form of a short tubular member which is formed of a suitable elastomeric material such as rubber, either natural or synthetic, or it may be formed from a highly resilient plastic material. An external annular groove 37 near the lower end of the nipple 32 receives the inner circular edge of the lid 14 and such edge may be adhesively held in position. The nipple 32 is provided with a central bore 38 adjacent its upper end and a reduced counterbore 40 adjacents its lower end, the two bores being connected by a frusto-conical valve seat 42 which is provided with a relatively small slant angle on the order of 5°. The valve body 34 is loosely disposed within the confines of the bore 38 and valve seat 42 and it is in the form of a spherical member such as a conventional ball bearing, such body being hereinafter referred to simply as a ball.

The ball 34 normally rests loosely on the valve seat as shown in FIG. 1. However, when the interior of the jar 10 is vacuumized, the consequent downward pull on the ball causes it to "sink", so to speak into the elastomeric material of the valve seat 42 as indicated at 44 in FIG. 1, thus establishing a positive and effective seal between the bores 34 and 40.

The aforementioned serrated washer 36 is provided for the purpose of capturing the ball 34 within the confines of the nipple 32, such washer being provided with internal teeth 48 so that the ball is unable to seat on the washer and prevent egress of air during jar evacuation operations or during handling of the lid 14. The washer 36 extends into an internal annular groove 50 which is formed near the upper end of the nipple 32.

The nipple assembly 30 is adapted to be operatively connected by means of a flexible tube 52 to a suitable source (not shown) of sub-atmospheric air pressure such as the vacuum chamber of an electric pump, or a suitable hand pump.

In the operation of the herein described jar sealing lid, assuming that the jar 10 is being used for initial food processing or "canning" purposes, the jar is filled with such foodstuff and is then closed by means of the lid 14 and its retainer 18, after which it is heated in accordance with known canning procedure. During heating of the jar, expansion of its contents forces air outwardly through the nipple 30, the ball rising from its frusto-conical seat 42 to permit upward passage of air. After the foodstuff has been adequately processed, the jar may be removed from the heating source and allowed to cool, in which case consequent tendency for the air within the jar to shrink establishes a partial vacuum within the jar tending to draw the ball 34 downwardly so that it seats upon the frusto-conical valve seat 42 so that no ambient air may enter the jar. With the nipple assembly 30 installed on the lid 18, a higher degree of vacuum can be attained than is usually the case when conventional jar covers which must be applied to the jar after the heating operation has been completed. Depending upon the quantity of air which collects in the upper region of the jar, the degree of vacuum which is attained by natural air shrinkage is limited although it is considered adequate for food preservation in most instances. However, if a jar is overfilled so that little or no air collects in the top of the jar, the degree of vacuum attained is very slight. Furthermore, during large scale canning operations where there are a large number of heated jars awaiting covering, by the time the operator reaches the last jar the contents thereof may have cooled considerably so that merely capping the jar and relying for cooling thereof to prevent contamination of the foodstuff by such ambient air is not an entirely safe procedure.

These situations can be avoided by utilizing the present nipple-equipped jar lid 14 and by connecting the flexible tubing 52 to the nipple 32 for jar evacuation purposes before an unreasonable length of time has elapsed after the jar heating operation. Care should be taken not to overfill the jars. During jar evacuation, the ball 34 will rise from its frusto-conical seat 42 as previously described and when the supply of sub-atmospheric pressure is discontinued, the ball will return to its seat and an extremely high degree of sub-atmospheric pressure will exist within the jar and effect seating of the ball by causing it to sink deep into the elastomeric material of the nipple 32 as clearly illustrated in FIG. 2.

The present invention is designed for use primarily in the resealing of jars since, during the initial sealing, air shrinkage within the jar is, more often than not, adequate to afford proper food protection. When resealing a jar after its contents have been partially consumed, there is a considerably larger air space within the jar and, although adequate evacuation of the jar might be obtained by reheating the jar, this ordinarily requires setting up the pressure cooker or other heating equipment that is employed and, for a single jar, this is not practical. Therefore, according to the present invention, it is merely necessary to evacuate the single jar in the manner previously described without going to the trouble of reheating the contents thereof.

It should be observed at this point that, as shown in FIG. 1, when the jar 10 is fully vacuumized to the extent necessary to preserve the contents thereof, there is a tendency for the lid 14 to flex inwardly or downwardly as shown by the dotted lines in this view. This flexing of the lid is usually accompanied by a snapping or clicking sound which may be relied upon by the operator to ascertain the fact that the source of vacuum pressure is, in fact, in existence. It is further pointed out that although the function of the retainer 20 is to cause initial proper seating of the lid 14 on the circular mouth of the jar 10, and also to hold the lid in place when the jar is empty or otherwise not vacuumized, such retainer is not essential for an adequate seal after the filled jar has been vacuumized. Once an evacuation of air from the interior of the jar has been effected, the jar may be stored on the shelf minus the retainer.

Figure 5:
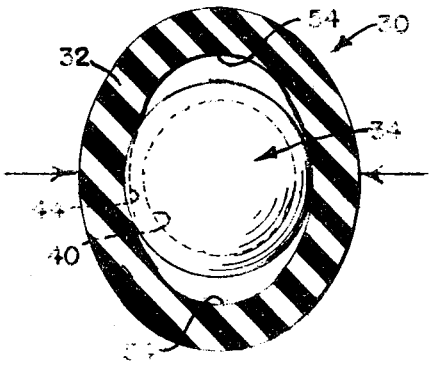
FIG. 5 is a sectional view taken on the line 5—5 of FIG. 2.
Figure 6:
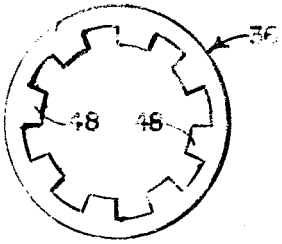
FIG. 6 is a plan view of a ball-retaining washer which is employed in connection with the invention.

When a particular vacuumized jar is removed from the shelf, or from storage, for the purpose of opening the same to gain access to the contents thereof, the usual difficulty of unscrewing the conventional jar lid or cap does not present itself when utilizing the lid 14 and retainer 20 of the present invention. Since there is no pressure differential involved in connection with the retainer 18, removal thereof from the jar is a comparatively easy matter and requires no excessive application of torque. Removal of the lid 14 is facilitated by manually evacuating the jar and this may be accomplished by the simple expedient of pinching the nipple 32 (so to speak) immediately below the level of the ball 34 so as to apply oppositely directed inward pressure thereto as shown by the opposed arrows in FIG. 5. This pinching action deforms the valve seat 44 and renders it generally elliptical or oval in transverse cross section as shown in FIG. 5, thereby creating crescent-shaped voids 54 on opposite sides of the ball 34 through which air may pass and proceed to the interior of the jar. With the inside and ambient air pressure thus equalized, the lid may be lifted from the jar without the use of a prying instrument.

The invention is not to be limited to the exact arrangement of parts shown in the accompanying drawings or described in this specification as various changes in the details of construction may be resorted to without departing from the spirit of the invention. For example, although the invention has been described in connection with the use of a glass jar of the Mason type, it is contemplated that the same may be equally effective when applied to metal containers, whether such containers be generally cylindrical or otherwise. The invention is also applicable to bottles and other small neck containers. Furthermore, although the jar 10 has been described herein as designed to contain foodstuff, the present invention is equally effective for use in the preservation of paint, lacquer, varnish, oil and the like which deteriorate with age when exposed to ambient atmosphere. Therefore, only insofar as the invention has particularly been pointed out in the accompanying claims is the same to be limited.

Having thus described my invention, what I claim and desire to secure by Letters Patent is:

1. The combination with an open-rimmed vessel such as a jar or the like adapted to contain a perishable foodstuff, of a closure lid seated on the rim of said vessel, means establishing a seal between said lid and the rim coextensively around the latter, said lid being provided with a vent opening therein, a hollow open-ended tubular nipple formed of yieldable elastomeric material and projecting upwardly from said vent opening and establishing communication between the interior of the jar and the ambient atmosphere, the upper end of said nipple being adapted for connection to a source of sub-atmospheric pressure, whereby the jar may be evacuated, said nipple being formed with an internal frusto-conical valve seat of small slant angle, a valve body in the form of a spherical ball disposed wholly within the vertical confines of the nipple, normally resting loosely, and bearing to a large extent circumferentially against said seat in sealing relationship, whereby the ball will deform the seat and come to rest thereon at different elevations when different degrees of sub-atmospheric pressure are maintained within the vessel, said seat being disposed in a medial region of the nipple, whereby inward pressure which is applied to the nipple at a level below the valve will deform the valve seat, at least partially unseat the ball, and permit air to flow downwardly through the nipple and around the opposite sides of the ball to thus relieve the sub-atmospheric pressure within the jar, and retaining means adjacent the upper end of the nipple for preventing the ball from escaping from the nipple under the influence of air which is drawn upwardly through the nipple, or during handling of the jar lid.

2. The combination set forth in claim 1, wherein said lid is generally in the form of a substantially flat disk conforming in outline to the outline of said rim, the vent opening is established by a centrally disposed hole which is provided in the disk, the lower end region of the nipple projects completely through said hole, and the edge region of said hole is embedded within the elastomeric material of the nipple.

3. The combination set forth in claim 1, wherein the retaining means for preventing the ball from escaping from the nipple is in the form of an internally serrated washer-like ring having its peripheral edge confined within an internal groove in the wall of the nipple.

4. The combination set forth in claim 3, wherein said tubular nipple is formed with a relatively large diameter bore in its upper region, a relatively small bore in its lower region, and the frusto-conical valve seat establishes communication between said bores.

5. The combination set forth in claim 4 wherein said open rimmed vessel is in the form of a glass jar having a reduced neck portion which is externally threaded, and a retaining ring of cup shaped design having an annular top wall and a depending skirt which is internally threaded is removably received over said reduced neck portion and serves to maintain said lid seated on the rim when the internal pressure within the jar equals the ambient pressure.

* * * * *